US005494123A

United States Patent [19]

Nguyen

[11] Patent Number: 5,494,123

[45] Date of Patent: Feb. 27, 1996

[54] DRILL BIT WITH PROTRUDING INSERT STABILIZERS

[75] Inventor: Quan V. Nguyen, Houston, Tex.

[73] Assignee: Smith International, Inc., Houston, Tex.

[21] Appl. No.: 317,340

[22] Filed: Oct. 4, 1994

[51] Int. Cl.[6] ..... E21B 10/46

[52] U.S. Cl. ..... 175/408; 175/332

[58] Field of Search ..... 175/325.1, 325.2, 175/331, 332, 339, 408, 420.1, 420.2, 421, 426

[56] References Cited

U.S. PATENT DOCUMENTS

| | | | |
|---|---|---|---|
| 3,120,285 | 2/1994 | Rowley | 175/408 |
| 3,134,447 | 5/1964 | McElya et al. | 175/332 |
| 3,628,616 | 12/1971 | Neilson | 175/408 |
| 4,140,189 | 2/1979 | Garner | 175/374 |
| 5,074,367 | 12/1991 | Estes | 175/408 |
| 5,394,952 | 3/1995 | Johns et al. | 175/332 |

FOREIGN PATENT DOCUMENTS 2203470A 10/1988 United Kingdom .

OTHER PUBLICATIONS

Varel Manufacturing Company brochure "Varel Rock Bits" publicaiton date, prior to Oct. 4, 1993.

*Primary Examiner*—Michael Powell Buiz

*Attorney, Agent, or Firm*—Christie, Parker & Hale

[57] ABSTRACT

A rotary cone rock bit has bearing inserts pressed into the side of the shirttail portion of the rock bit body for stabilizing the rock bit during drilling. Such a rock bit has a steel bit body with a threaded upper pin for connection to a drill string. Cutter cones are mounted on lower leg portions of the rock bit body. The rock bit body gradually decreases in diameter from the gage diameter adjacent the lower tips of the shirttails adjacent to the cones to a smaller diameter shoulder the pin end of the body. The lowermost bearing insert protrudes laterally from the gradually decreasing diameter part of the bit body approximately half way between the lower tip of the shirttail and the shoulder at the upper end of the shirttail. The outer ends of the bearing inserts are rounded and substantially at the gage diameter of the bit for bearing on the wall of the borehole being drilled without appreciably reaming the borehole. The bearing inserts may have a layer of polycrystalline diamond on the protruding ends for minimizing wear. The protruding bearing inserts stabilize the bit without disrupting fluid flow around the bit.

15 Claims, 1 Drawing Sheet

DRILL BIT WITH PROTRUDING INSERT STABILIZERS

BACKGROUND

This invention relates to a rock bit with a built-in stabilizer on the bit body that can contact the wall of a borehole without unduly disrupting fluid flow or generating elevated temperatures in the adjacent bit body.

Heavy-duty drill bits or rock bits are employed for drilling wells in subterranean formations for oil, gas, geothermal steam, and the like. Such rock bits have a body connected to a drill string and generally three hollow cutter cones mounted on the body for drilling rock formations. Each cutter cone occupies a major part of a 120° sector of the bit. The cutter cones are mounted on steel journals or pins integral with the bit body at its lower end. In use, the drill string and rock bit body are rotated in the borehole, and each cone is caused to rotate on its respective journal as the cone contacts the bottom of the borehole being drilled.

Each cutter cone has a number of generally circular rows of inserts or cutting elements. In some rock bits the cones have hardened steel teeth integral with the cone, which may also be coated with a hardfacing material. Many cones have cemented tungsten carbide inserts forming the cutting elements. As the cone rotates, the inserts of each row are applied sequentially in a circular path on the bottom of the borehole in the formation being drilled. As the cutter cones roll on the bottom of the borehole the teeth or carbide inserts apply a high compressive load to the rock and fracture it. The cones may be skewed from a radial direction to force some "skidding" action. The cutting action in rolling cone cutters is typically by a combination of crushing and chipping the rock formation.

In operation, a rock bit is attached to the lower end of a hollow drill string that extends from the ground surface to the rock bit at the bottom of a borehole being drilled. The drill string is rotated by the drill rig at the ground surface (or sometimes a downhole motor is used) which rotates the drill bit around it's longitudinal axis on the bottom of the borehole. Thus, the rolling cutter cones are caused to rotate and as weight is applied to the bit by the weight of the drill string, the carbide inserts in the cones crush, chip, gouge, and scrape the formation to dislodge chips of rock. Drilling fluid is pumped downwardly through the drill string and rock bit, returning to the surface via the annular space between the drill string and the wall of the borehole being drilled. The particles of rock formation dislodged by the bit are carried out of the borehole by drilling fluid. The drilling fluid also cools the bit.

The tungsten carbide inserts along the periphery of a bit that is nearest the base of the cones and which define the diameter of the hole being drilled are known as gage inserts. As the rolling cutter cones rotate, the gage inserts engage rock at the periphery (or gage) of the hole being drilled to dislodge rock formation. The gage inserts are most susceptible to wear because they undergo both abrasion and compression as they scrape against the gage of the borehole. Appreciable wear on the gage inserts is undesirable because this may result in an undersize borehole. When a replacement drill bit is inserted toward the bottom of an undersized borehole, the replacement bit may pinch against the hole wall and cause premature wear of the gage inserts and overload of the bearings between the rock bit body and cutter cones.

The cones on a rock bit are, therefore, commonly provided with a circular row of inserts adjacent to the base of the cone known as heel row inserts. The cones are angled so that the faces of the heel row inserts define the gage of the rock bit.

The cutter cones are mounted on journal pins extending downwardly and inwardly from a leg portion of the rock bit body. The lowermost portion of the leg, which is the largest diameter portion of the rock bit, is rounded and relatively thin where it covers the base of the cone. The exterior of the bit body has a curved face which has come to be known as the shirttail. This name derives from the curved lower edge of the face adjacent to the cone. Recessed channels extend longitudinally along the bit body towards the pin end between the shirttail portions. The shirttail portion of the rock bit body may be bare steel or the lower edge may have a layer of hardfacing deposited thereon to minimize wear due to rubbing of the shirttail against the wall of the borehole.

The drill string has a smaller diameter than the borehole being drilled. This, of course, creates a certain amount of angularity to the drill string which may be imparted to the rock bit itself. If the rock bit tilts, even though the angle may be very small, there can be excessive pressure of the lower portions of the bit against the rock formation as the bit is rotated. This may cause undue wear of the shirttail.

Stabilizers are often mounted in the drill string above the rock bit for minimizing the tilting of the rock bit. A stabilizer is a sub having a diameter close to the gage of the borehole to keep the drill string centered. Preferably, the use of such stabilizer subs is to be avoided.

Many years ago it was decided to form stabilizer pads integral with the rock bit body an appreciable distance above the bottom of the shirttail. Such an integral stabilizer is described and illustrated in U.S. Pat. No. 3,628,616, for example. The stabilizer pad on the rock bit body was a significant advance that helped maintain the direction of drilling and minimize undue wear on the shirttail.

The integral stabilizer pad may be a raised portion of steel forged integral with the rest of the bit body. A stabilizer pad may also be a piece of steel welded onto the bit body or a pad of steel built up with weld metal which is then machined or ground to a desired final shape. The pad may be steel coated with hardfacing for wear resistance or a separate pad of hardfacing material may be brazed to the steel body. Such a stabilizer pad may have flat cemented tungsten carbide inserts which bear against the gage of the borehole and stabilize the bit.

Although the stabilizer pad on the bit body was recognized as a significant advance and has been adopted for many models of drill bits, some of its shortcomings have been recognized, particularly in recent years when rock bits have been operated at higher rotational speeds. Heating of the rock bit body as a consequence of friction between the stabilizer pad and borehole wall may become significant.

The cutter cones mounted on the rock bit body are lubricated by a viscous grease which is filled within a space around the cone bearings. Pressure and temperature variations in the rock bit environment may limit the ability to seal the grease in and seal abrasive drilling fluid out. Many modern rock bits are, therefore, provided with a pressure compensated grease reservoir in an upper portion of the bit body for maintaining grease at the bearing surfaces. Unfortunately, the stabilizer pads are adjacent the grease reservoir and heating may reduce the viscosity of the grease, thereby reducing its capability for lubricating the bearing surfaces.

Even without a grease reservoir, it is undesirable to have excessive temperatures generated.

Part of the heating problem is due to the stabilizer pad. Heat is carried away from the rock bit by the drilling fluid flowing upwardly through the annulus between the rock bit body and the wall of the borehole. A drilling pad bearing against the wall of the borehole leaves no room for circulation of drilling fluid and extraction of heat. This can be exacerbated by packing of particles around the stabilizer pad, which further inhibits flow of drilling fluid.

Excess heat may also deteriorate the rubber boot in the grease reservoir and its failure may lead to rapid failure of the rock bit when the bearings are no longer properly lubricated.

A problem sometimes occurs with stabilizer pads that are welded onto the body instead of forged integral with the body. The welding to build up the body or add a steel pad may produce a stress riser below the pad as well as damaging the metallurgical properties of the steel. This has actually resulted in breakage of the legs of the bit. This not only disrupts drilling, but the resultant junk can be costly to fish or mill from the borehole. Most such failures come from welded on pads or built-up pads.

The stabilizer pads also act somewhat like paddles rotating in the borehole, which disrupt upward flow of fluid which carries away the particles of rock produced by drilling. The disrupted fluid flow may cause abnormal packing of the reservoir cap with formation that may prevent the grease compensation reservoir from functioning or may dislodge the reservoir cover cap from the bit, both of said conditions will lead to premature bearing failure.

Integral stabilizer pads are commonly made with sloping upper and lower faces, however, abrasion commonly causes the taper to wear away, leaving a sharp ledge, particularly at the lower edge of the stabilizer pad. Due to the vagaries of drilling rock bits sometimes temporarily drill an offset or oversize hole. After an episode of such drilling a small shoulder may be formed in the wall of the borehole. When the stabilizer pads encounter the shoulder, they may hang up on the shoulder and retard drilling. In severe cases bits may get stuck when tripping into a hole. This problem is common enough that there are experienced drillers that refuse to use bits with stabilizer pads.

It would therefore be desirable to eliminate the stabilizer pad. However, at the same time it is desirable to maintain the enhanced stability. Satisfaction of these countervailing desiderata is provided in practice of this invention.

SUMMARY OF THE INVENTION

There is, therefore, provided in practice of this invention according to a presently preferred embodiment, a rotary cone rock bit for drilling subterranean formations with improved means for stabilizing the bit. The rock bit comprises a bit body with an upper threaded pin end for connection to a drill string. A plurality of journal pins extend downwardly and inwardly from a lower leg portion of the bit. Each journal pin has a bearing surface and a cutter cone rotatably mounted on the pin with a cone bearing surface adjacent the bearing surface on the journal pin. Each leg portion includes a shirttail with a curved edge at its lower end adjacent to the gage of the rock bit and a shoulder at its upper end near the pin end of the bit. Stabilizing of the rock bit is obtained by way of a plurality of bearing inserts protruding laterally from the shirttail portion of bit body between the lower edge of the shirttail and the upper shoulder. The outer ends of the bearing inserts are substantially at the gage diameter and are rounded for bearing on the wall of a borehole without appreciable reaming of the borehole wall. The lowest of the bearing inserts is approximately half way between the lower tip of the shirttail and the shoulder. Drilling fluid flows around the protruding inserts, helping with cooling and avoiding disruption of fluid flow between the bit and the wall of the borehole.

In an exemplary embodiment there is a pressure-compensated grease reservoir for each set of bearing surfaces in a portion of the bit body near the shoulder at the upper end of the shirttail for maintaining grease adjacent the bearing surfaces for the cones. The bearing inserts stabilize the bit without undue heating of the grease reservoir.

BRIEF DESCRIPTION OF THE DRAWINGS

These and other features and advantages of the present invention will be more fully understood upon a study of the following detailed description in conjunction with the accompanying drawings wherein.

DETAILED DESCRIPTION

A rock bit constructed according to principles of this invention comprises a steel body 10 having three cutter cones 11 mounted on its lower end. A threaded pin 12 is at the upper end of the bit body for assembly of the rock bit onto a drill string for drilling oil wells or the like. A plurality of cemented tungsten carbide inserts 13 are pressed into holes in the surfaces of the cutter cones for bearing on the rock formation being drilled. Nozzles 15 in the bit body introduce drilling fluid into the space around the cutter cones for cooling and carrying away formation chips drilled by the bit.

Figure 1:
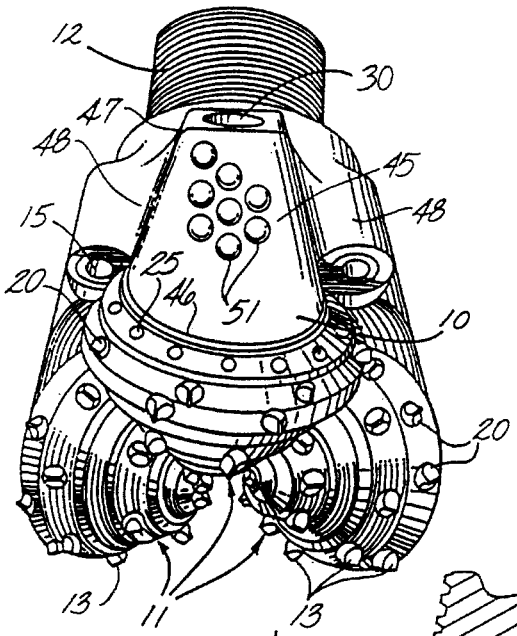
FIG. 1 is a perspective view of a rock bit constructed according to the principles of this invention.
Figure 2:
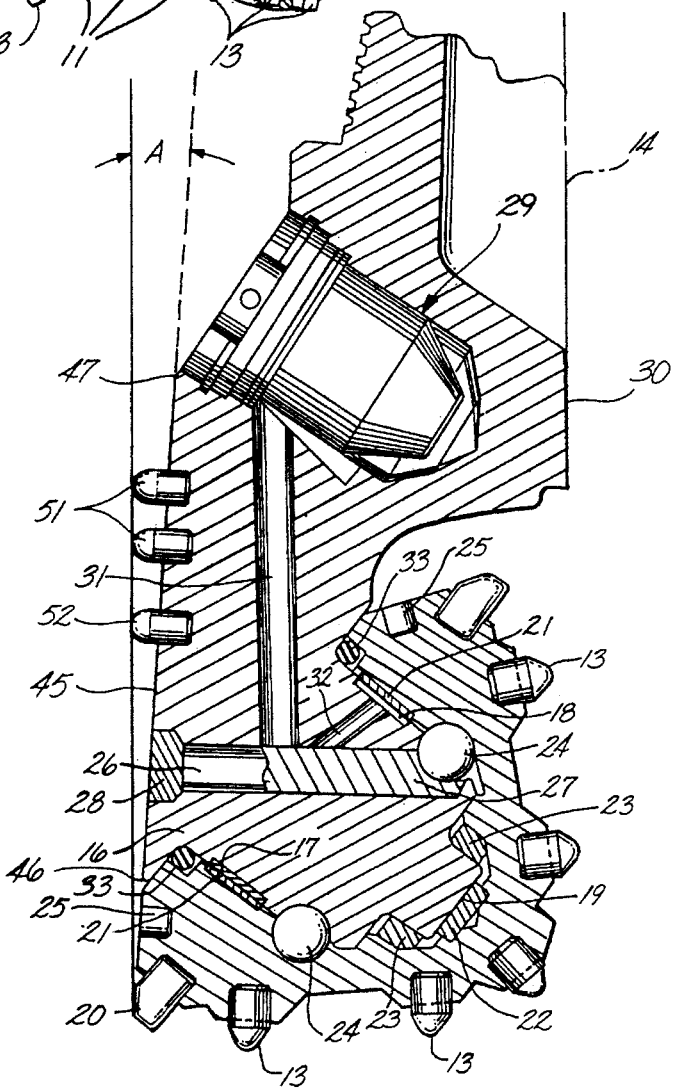
FIG. 2 is a partial cross-section of the rock bit illustrated in FIG. 1.

FIG. 2 is a fragmentary longitudinal cross-section of the rock bit, extending radially from the rotational axis 14 of the rock bit through one of the three legs on which the cutter cones 11 are mounted. Each leg includes a journal pin 16 extending downwardly and radially inwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60% or so of the circumference of the journal pin, and the hard metal insert 17 can extend around the remaining 40% or so. The journal pin also has a cylindrical nose 19 at its outer end.

Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

A circumferential row of inserts 20 near the base of the cone drill formation adjacent to the periphery or "gage" of the borehole. A row of heel row inserts are pressed into an adjacent circumferential surface of the cone. The outer faces of the heel row inserts bear against the wall of the borehole. The heel row inserts are on the gage diameter of the rock bit and together with the gage row inserts assure that the borehole is drilled at full gage.

The cavity in the cone contains a cylindrical bearing surface including an aluminum bronze inlay 21 deposited in a groove in the steel of the cone or as a floating insert in a groove in the cone. The aluminum bronze insert 21 in the cone engages the hard metal inlay 17 on the leg and provides the main bearing surface for the cone on the bit body. A nose button 22 is between the end of the cavity in the cone and the nose 19 of the journal pin and carries the principal thrust loads of the cone on the journal pin. A bushing 23 surrounds the nose and provides additional bearing surface between the cone and journal pin. Other types of bits, particularly for higher rotational speed applications, have roller bearings instead of the exemplary journal bearings illustrated herein.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

A variety of other bearing arrangements and materials may be used in other embodiments of rock bits and the specific details of the cones or cone mounting means do not form part of this invention.

In high performance rock bits, the bearing surfaces between the journal pin and the cone are lubricated by a grease. Preferably, the interior of the rock bit is evacuated and grease is introduced through a fill passage (not shown). The grease thus fills the regions adjacent the bearing surfaces plus various passages and a grease reservoir, and air is essentially excluded from the interior of the rock bit.

The grease reservoir comprises a cavity 30 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of an O-ring 33 between the cone and journal pin.

A conventional pressure compensation subassembly 29 is included in the grease reservoir 30. The subassembly, the details of which are not illustrated, comprises a metal cup with an opening at its inner end. A flexible rubber bellows or "boot" extends into the cup from its outer end. The bellows is held in place by a cap with a vent passage. The pressure compensation subassembly is held in the grease reservoir by a snap ring. If desired, a pressure relief check valve can also be provided in the grease reservoir for relieving over-pressures in the grease system that could damage the O-ring seal.

When the rock bit is filled with grease, the bearings, the groove 18 on the journal pin, passages in the journal pin, the lubrication passage 31, and the grease reservoir on the outside of the bellows are filled with grease. If the volume of grease expands due to heating, for example, the bellows is compressed to provide additional volume in the sealed grease system, thereby preventing accumulation of excessive pressure. High pressure in the grease system can damage the O-ring seal 33 and permit drilling fluid or the like to enter the bearings. Such material is abrasive and can quickly damage the bearings. Conversely, if the grease volume should contract, the bellows can expand to prevent low pressure in the sealed grease system, which could cause flow of abrasive and/or corrosive substances past the O-ring seal.

The lower edge 46 of the leg of a rock bit is rounded where it covers the base of a cutter cone and because of this shape the three faces of the bit body are commonly referred to as shirttails 45. In this embodiment the outer circumferential surface of the shirttail tapers gradually inwardly above the lower edge to a shoulder 47 just below the grease reservoir near the pin end of the bit. A typical taper angle A is about 1 to 5 degrees. Some bits have no taper on the shirttail and others may have shallow steps along the length of the shirttail to, in effect, provide a taper.

Preferably the tip of the shirttail and edge of the shoulder are protected with a layer of wear resistant hardfacing (not shown) brazed to the surface of the steel. A recessed channel 48 extends longitudinally between the shirttail portions of the bit body towards the pin end. The drilling fluid nozzles 15 are typically located in this channel. If desired, extended nozzles may be used for ejecting drilling fluid closer to the space between adjacent cutter cones. Regardless of where ejected, drilling fluid carrying particles of drilled formation passes upwardly through the channels and through the annulus between the shirttail portions of the bit body and the wall of the borehole.

A plurality of bearing inserts 51 are pressed into the bit body in the gradually tapering portion of the leg between the recesses. The lowermost of the bearing inserts 52 is approximately half way between the lowermost tip of the curved edge of the shirttail and the shoulder 47. The balance of the bearing inserts are located between the lowermost insert and the shoulder.

The inserts are placed in this location so that there is sufficient steel between the inserts and the grease passage 31 between the reservoir and bearing surfaces for retaining the inserts in the insert holes. The bearing inserts are also spaced apart from the grease reservoir so that heat generated by friction of the bearing inserts against the borehole wall is also spaced apart from the reservoir, thereby helping assure that the grease is not overheated. A similar location is used when there is no grease reservoir, for example, in an air cooled drill bit with open bearings.

The ends of the bearing inserts protrude laterally (not necessarily radially) from the surface of the bit body so that their protruding ends are substantially on the gage diameter of the bit. The protruding ends of the inserts are rounded. Thus, the bearing inserts bear against the borehole wall for stabilizing the bit. The rounded ends on the bearing inserts prevent appreciable reaming or 'grabbing' of the borehole, which would effectively lose the desired stabilization. Although illustrated as generally hemispherical, a longer radius or asymmetrical rounding may be used.

The protruding bearing inserts are spaced apart so that drilling fluid flows around the inserts and up the annulus. Flow around the inserts helps remove frictional heat and helps protect the bit from overheating. Furthermore, the absence of a stabilization pad also avoids the effect of a "paddle" rotating in the hole. Particles in the drilling fluid do not pack around the spaced apart protruding inserts the way it does around a stabilization pad. Disrupted flow which erodes the cap and the grease reservoir may also be avoided. The rounded bearing inserts are not found to wear to form a ledge that can hang up on shoulders in a borehole wall.

Although, only one embodiment of an improved rock bit with stabilization has been described and illustrated herein, many modifications and variations will be apparent to those skilled in the art. For example, bearing inserts may be used in rock bits with milled tooth cutters instead of the insert cutter cones described herein. The bearing inserts may have a layer of polycrystalline diamond on the protruding ends for minimizing wear of the inserts. Accordingly, it is to be understood that within the scope of the appended claims, this invention may be practiced otherwise than as specifically described.

What is claimed is:

1. A rotary cone rock bit for drilling subterranean formations comprising:

a bit body having an upper pin end for connection to a drill string and a plurality of lower leg portions, each leg portion including a shirttail with a tip at its lower end adjacent to the gage of the rock bit and a shoulder adjacent the upper pin end of the bit;

a journal pin on each leg portion;

a cutter cone rotatably mounted on each journal pin; and a first non-cutting bearing insert protruding laterally from the shirttail portion of the bit body approximately half way between the lower tip of the shirttail and the shoulder, the outer end of the bearing insert being substantially at the gage diameter for bearing on a wall of a borehole.

2. A rock bit as recited in claim 1 further comprising a plurality of additional bearing inserts between the first bearing insert and the shoulder, the outer ends of the additional bearing inserts also being non-cutting and substantially at the gage diameter.

3. A rotary cone rock bit for drilling subterranean formations comprising:

a bit body having an upper pin end for connection to a drill string and a plurality of lower leg portions, each leg portion including a shirttail with a tip at its lower end adjacent to the gage of the rock bit and a shoulder adjacent the upper pin end of the bit;

a journal pin on each leg portion;

a cutter cone rotatably mounted on each journal pin; and a first bearing insert protruding laterally from the shirttail portion of the bit body approximately half way between the lower tip of the shirttail and the shoulder;

a plurality of additional bearing inserts between the first bearing insert and the shoulder, the outer ends of each of the bearing inserts being substantially at the gage diameter for bearing on a wall of a borehole, and wherein the protruding ends of the bearing inserts are rounded for minimizing reaming of a borehole diameter.

4. A rock bit as recited in claim 3 further comprising a layer of polycrystalline diamond on the protruding end of each of at least a portion of the bearing inserts for minimizing wear of the inserts.

5. A rock bit as recited in claim 1 further comprising a pressure-compensated grease reservoir for providing grease for each journal pin and cutter cone, located adjacent to the respective shoulders, and wherein the bit body gradually decreases in diameter from a larger gage diameter adjacent the lower tips of the shirttails toward the shoulder adjacent to the grease reservoirs.

6. A rotary cone rock bit for drilling subterranean formations comprising:

a bit body having an upper threaded pin end for connection to a drill string and a plurality of lower leg portions, each lower leg portion including a shirttail outer face portion extending from a lower tip adjacent to the gage of the rock bit to a shoulder below the pin end, and a recessed channel extending longitudinally between adjacent shirttail portions toward the pin end;

a cutter cone rotatably mounted on each leg portion for drilling rock formation and forming a borehole; and a first bearing insert protruding laterally from a shirttail portion of the bit body between the recesses approximately half way between the lower tip of the shirttail and the shoulder, the outer end of the bearing insert being rounded for bearing against a borehole wall without appreciable reaming of the borehole wall.

7. A rock bit as recited in claim 6 further comprising a plurality of additional bearing inserts between the first bearing insert and the shoulder, the outer ends of the additional bearing inserts also being rounded.

8. A rock bit as recited in claim 7 wherein the rounded outer end of each insert is substantially at the gage diameter for bearing on the wall of a borehole.

9. A rock bit as recited in claim 8 further comprising a layer of polycrystalline diamond on the protruding end of each of at least a portion of the bearing inserts for minimizing wear of the inserts.

10. A rock bit as recited in claim 6 wherein the shirttail portions of the bit body gradually decrease in diameter from a larger gage diameter adjacent the lower tip of the shirttails to a smaller diameter adjacent the shoulders.

11. A rotary cone rock bit for drilling subterranean formations comprising:

a bit body having an upper pin end for connection to a drill string and including a plurality of journal pins each extending downwardly and inwardly from a lower leg portion of the bit and having a bearing surface, each leg portion including a shirttail extending from a rounded tip at its lower end adjacent to the gage of the rock bit and a shoulder at its upper end adjacent the pin end;

a cutter cone rotatably mounted on each journal pin, each cutter cone comprising:

a bearing surface adjacent the bearing surface on the journal pin, a plurality of cutter inserts in the cutter cone for drilling rock formation on the bottom of a borehole, and a plurality of heel row inserts in a portion of the cutter cone adjacent to the gage of the rock bit;

a pressure-compensated grease reservoir for each set of bearing surfaces in a portion of the bit body between the pin end and the shoulder at the upper end of the shirttail, and in fluid communication with such bearing surfaces;

a grease in the grease reservoir and adjacent the bearing surfaces;

the bit body gradually decreasing in diameter from a larger gage diameter adjacent the lower tips of the shirttails to a smaller diameter adjacent to the shoulders; and a plurality of bearing inserts protruding laterally from the gradually decreasing diameter portion of bit body between the lower tip of each shirttail and the respective shoulders, the outer ends of the bearing inserts being non-cutting and substantially at the gage diameter.

12. A rock bit as recited in claim 11 wherein the outer ends of the bearing inserts are rounded for bearing against a borehole wall without appreciable reaming of the borehole wall.

13. A rock bit as recited in claim 11 wherein at least one of the bearing inserts is approximately half way between the shoulder and the lower tip of the shirttail.

14. A rock bit as recited in claim 13 wherein the balance of the bearing inserts are between said at least one bearing insert and the shoulder.

15. A rock bit as recited in claim 11 further comprising a layer of polycrystalline diamond on the protruding end of each of at least a portion of the bearing inserts for minimizing wear of the inserts.

* * * * *